United States Patent [19]

Tüns

[11] 4,198,166

[45] Apr. 15, 1980

[54] DEVICE FOR SHAKING PACKAGES CONTAINING POWDERY OR GRANULAR MATERIAL

[75] Inventor: Josef Tüns, Dachsen, Switzerland

[73] Assignee: SIG Schweizerische Industrie-Gesellschaft, Neuhausen am Rheinfall, Switzerland

[21] Appl. No.: 953,181

[22] Filed: Oct. 20, 1978

[30] Foreign Application Priority Data

Nov. 1, 1977 [CH] Switzerland ..... 13324/77

[51] Int. Cl.[2] ..... B01F 11/00; B65B 61/00

[52] U.S. Cl. ..... 366/112; 53/525; 141/80

[58] Field of Search ..... 366/108, 109, 111, 112, 366/114, 128, 208, 212, 218, 240; 141/74, 78, 80; 53/525

[56] References Cited

U.S. PATENT DOCUMENTS

| | | | |
|---|---|---|---|
| 868,605 | 10/1907 | Heybach | 366/218 |
| 935,506 | 9/1909 | Heybach | 141/80 X |
| 2,083,067 | 6/1937 | James | 53/525 |
| 3,115,905 | 12/1963 | Lau | 366/108 X |

*Primary Examiner*—Philip R. Coe

*Attorney, Agent, or Firm*—Spencer & Kaye

[57] ABSTRACT

A device for shaking packages each positioned with a downwardly oriented, recessed end face on an intermittently advanced conveyor (equipped with carrier elements for engaging and advancing the packages) has at least one vertically displaceable platform which is situated underneath the conveyor and which has a discrete outline dimensioned for engaging the recessed end face of the individual package. The platform is shifted into a raised state for thereby lifting the package off the respective carrier element by the recessed end face and then the platform is vertically reciprocated for shaking the package as it rests on the platform by the recessed end face.

4 Claims, 7 Drawing Figures

DEVICE FOR SHAKING PACKAGES CONTAINING POWDERY OR GRANULAR MATERIAL

BACKGROUND OF THE INVENTION

This invention relates to a device for shaking packages which contain a powdery or granular material and which are positioned on an intermittently driven conveyor provided with carrier elements for advancing the packages. Each package has an inner bag made of a sealable foil material which is surrounded by and bonded to an outer box made of a more rigid material. The outer box has, at one end face, a collar which extends beyond the inner bag and into or about which a lid may be inserted.

It is known to mount shaking devices on apparatuses for filling packages with powdery or granular material. Such shaking devices which densify the material in the package, have several advantages. By densifying the material, the latter assumes a lesser space per unit weight. Therefore, smaller packages may be used for the same amount of goods, thus resulting in the economy of the packaging material. Further, the goods, as they are transported in completed packages, for example by trucks, will not be further densified as a result of vibrations during travel, so that the packages, when presented to the final consumer, have a well-filled appearance.

The shaking of packages that have a flat bottom involves no difficulties. It is, for example, known to push the packages over a floor or rails which are vibrated. Packages which have a collar will be somewhat deformed at the edge of the package bottom when shaken; such an effect, however, is insignificant in the usual packages.

There are, however, packages which have an inner bag made of a sealable material which is surrounded by an outer box made of a more rigid material such as described, for example, in German Laid-Open Application (Offenlegungsschrift) No. 2,641,796. Such a package has, at one end face, a collar which projects beyond the inner bag. In the recess formed by the collar a lid may be inserted which, subsequent to the opening of the inner bag, serves for reclosing the opened package. For manufacturing reasons, in such packages it is necessary to first close the top having the projecting collar, then invert the package 180° and fill the same through the still open bottom and subsequently close the bottom. Heretofore, it has not been possible to vigorously shake such packages in order to well densify the contents, since the packages, during filling, have rested only at the edges of the projecting collar on the vibrating bottom or vibrating rails. The vibration has caused a deformation of these edges with the disadvantageous result that the lid could no longer be inserted in a satisfactory manner into the recess defined by the collar.

SUMMARY OF THE INVENTION

It is an object of the invention to provide an improved shaking device of the above-outlined type which does not cause a deformation of the projecting collar of the package.

This object and others to become apparent as the specification progresses, are accomplished by the invention, according to which, briefly stated, underneath the conveying apparatus there is arranged at least one vibrating platform which is displaceable vertically and which is so dimensioned that during the standstill of the conveying apparatus, it penetrates into the recess defined by the projecting collar of the outer box, lifts the package off the carrier elements of the conveyor by the recessed end face of the inner package engaging the platform and imparts a shaking motion to the package.

Expediently, a plurality of the above-outlined vibrating platforms are provided, some of which are effective during the filling operation, while others operate after the filling operation has been completed.

DETAILED DESCRIPTION OF THE PREFERRED EMBODIMENT

Figure 1A:
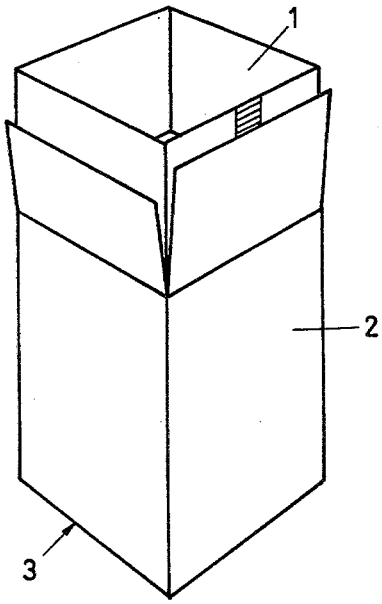
FIGS. 1*a* and 1*b* are perspective views of inverted packages having a still-open bottom for being filled from above and to be shaken according to the invention.
Figure 1B:
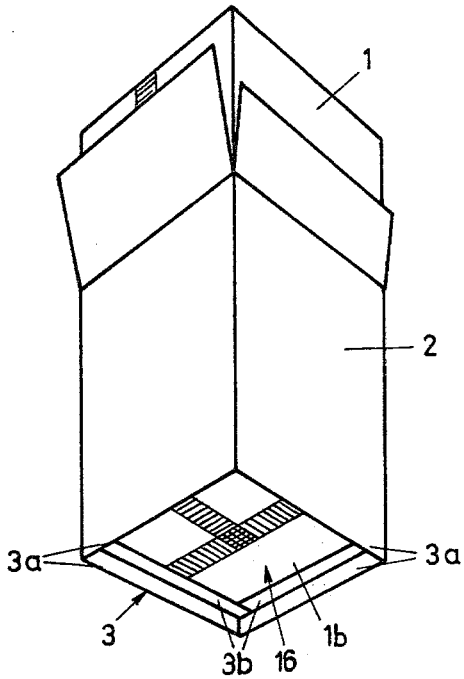
Figure 2:
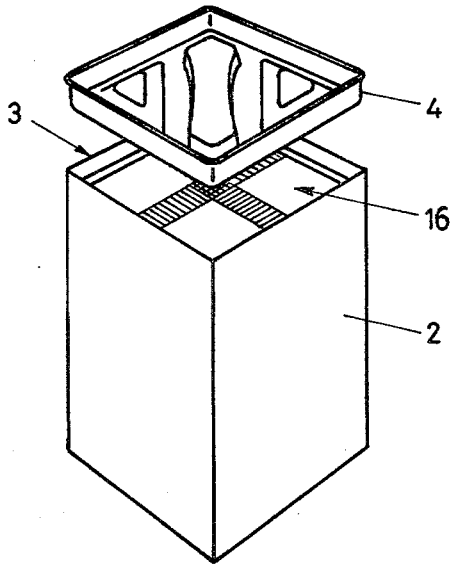
FIG. 2 is a perspective view of a finished, closed package prior to inserting a lid.

Turning to FIGS. 1*a* and 1*b*, there is shown, in an inverted orientation, a package which has a not yet closed inner bag 1 made of a flexible sealable sheet material and a more rigid outer box 2 made, for example, of cardboard. As it may be observed particularly in FIG. 1*b*, the package has, at the top 1*b* of the inner bag 1, a circumferential collar 3 which projects beyond the top 1*b* of the inner bag 1 and which is an integral part of the outer box 2. The package is, as it will be discussed later in detail, automatically filled, shaken and subsequently closed by an apparatus. In FIG. 2 there is shown, in an upright orientation, the completed package prior to the insertion of a lid 4 which is received in a recess 16 defined by the collar 3.

The package is, in its inverted position, filled through its still open bottom and is oriented into its upright position only after the bottom is closed. During the filling and the shaking the package thus rests on the edges 3*a* of the collar 3. The edges 3*a* and the collar 3 must not be deformed or otherwise damaged by the shaking device to ensure that the lid 4 may be inserted in a satisfactory manner. This is also of importance if another type of lid is used, for example, a lid which is pushed over the sides of the collar 3.

Figure 3:
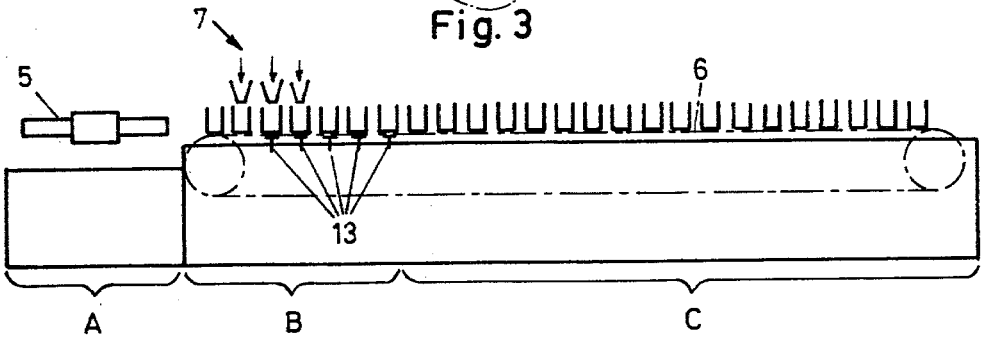
FIG. 3 is a schematic side elevational view of an apparatus for filling, shaking and closing packages of the type illustrated in FIGS. 1*a* and 1*b*, including an intermittently operated conveyor chain with package carrying elements.

Turning now to FIG. 3, there is shown in a schematic manner the operational principle of an apparatus for making, filling, shaking and closing packages. Prior art apparatuses generally performing these functions are disclosed, for example, in U.S. Pat. No. 3,373,663 and Swiss Pat. No. 410,752.

The package (box assembly) is prepared at the station A on intermittently rotating folding mandrels 5. The still-open package, as illustrated in FIGS. 1*a* and 1*b*, is thereafter transferred to an intermittently advanced endless chain 6 which has carrier elements for the individual packages. In the zone B the packages are filled by means of a dosing device 7 and are thereafter shaken. In the zone C the packages are closed.

Figure 6:
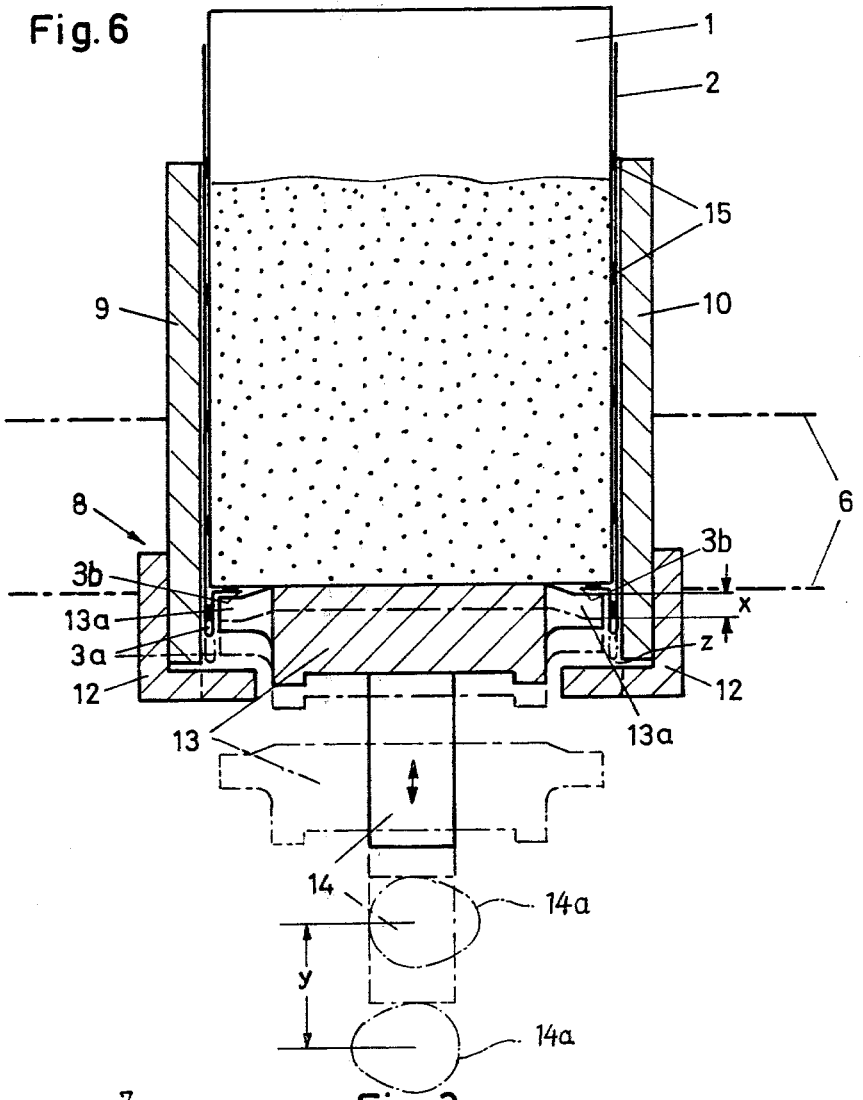
FIG. 6 is a sectional view taken along line VI—VI of FIG. 5 illustrating a filled package with the vibrating platform in the operational position.
Figure 4:
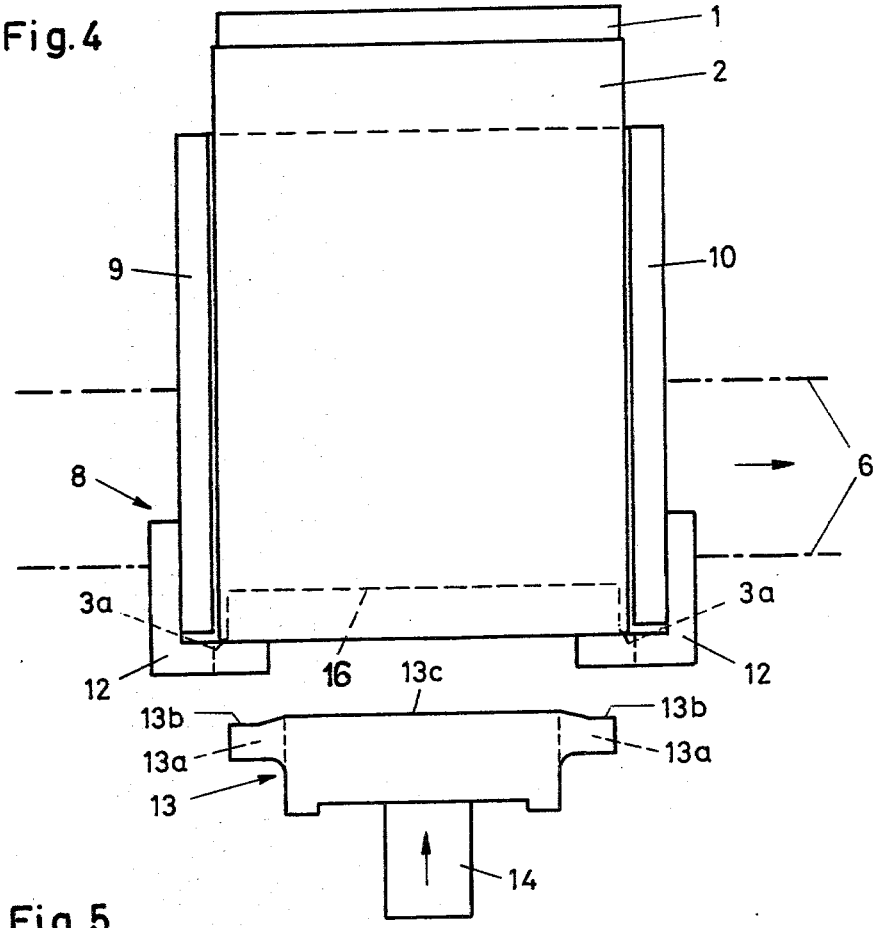
FIG. 4 is a side elevational view of a conveyor carrier element with a package and a vibrating platform in the position of rest.
Figure 5:
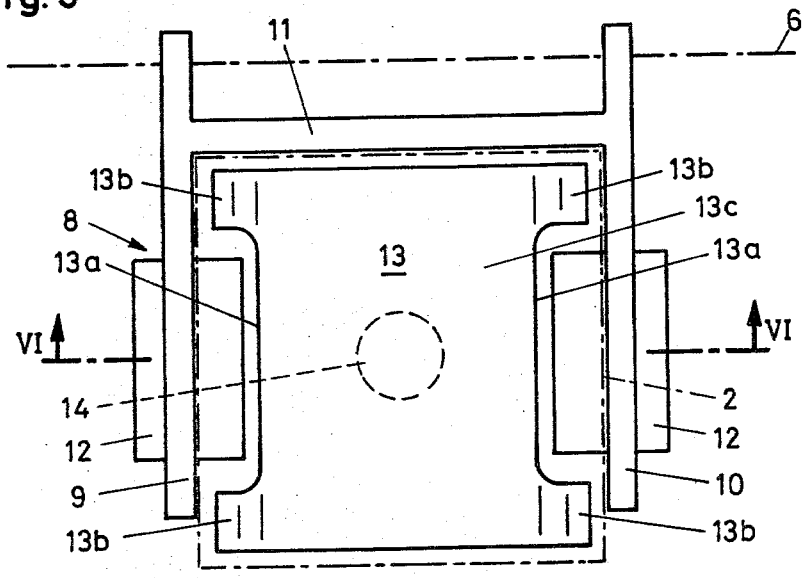
FIG. 5 is a top plan view of the arrangement shown in FIG. 4.

With regard to the present invention only the structure of the shaking device in zone B is of interest. FIGS. 4, 5 and 6 show the essential components of the shaking device. To the endless chain 6 which is only symbolically illustrated, there are secured carrier elements 8 each designed for engaging and advancing one package. The carrier elements 8 are bottomless and each has two lateral walls 9 and 10 and a rear wall 11. In order to prevent the packages from dropping out, to the lateral walls 9, 10 there are secured angled carriers 12 which engage only the central part of the edges 3*a* of the collar 3 as shown in FIG. 4. The package 1, 2 is surrounded by the walls 9, 10, 11 with a clearance, so that the package may be easily lifted relative to the walls 9, 10, 11. The lifting and the subsequent shaking of each package 1, 2 is effected by a vibrating platform 13 which is, in its plan view outline (FIG. 5), slightly smaller than the inner width of the collar 3 of the package. Consequently, the platform 13 may penetrate into the recess defined by the collar 3 with a clearance, as shown in FIG. 6. The platform 13 has two lateral cutouts 13*a* which ensure that, as best seen in FIG. 5, the vibrating platform 13 does not come into contact with the angled carriers 12. The upper face 13*b* of the four platform portions situated externally of the cutouts 13*a* are located at a somewhat lower level than the upper face 13*c* of the middle zone of the vibrating platform 13. The upper face 13*c* of the middle zone may be slightly upwardly convex or, it is feasible that it is coplanar with the surfaces 13*b*. FIG. 6 shows a filled package in section during the shaking operation. The inner bag 1 is bonded to the inner wall of the outer box 2 by adhesive strips 15.

The vibrating platform 13 is shown in its uppermost position in FIG. 6 in solid lines. The two phantom line positions indicate the position of rest as illustrated in FIG. 4 and the lowermost position during the shaking operation. The distance x is thus the amplitude of the shaking stroke. It is essential that the edges 3*a* of the collar 3 do not contact the horizontal portion of the angled carrier 12 during the shaking operation.

In the description which follows the operation of the above-described apparatus will be set forth.

As soon as the endless chain 6 with the carrier elements 8 is advanced one step and thus a new package is positioned over the first vibrating platform 13, the latter is lifted into its operational position as shown in FIG. 6 and is vibrated in the vertical direction with the amplitude x. The vibrating platform 13 is thereafter brought into its position of rest and then the chain 6 is again advanced one step. It is expedient—as indicated in FIG. 3—to provide serially several vibrating platforms so that the material contained in the packages can be satisfactorily densified by repeated shaking. The vibrating amplitudes x of the several vibrating platforms 13 may be of unlike magnitudes.

The actuation of the vibrating platforms 13 may be effected in a manner conventional by itself. For example, a push rod 14 may be provided which is secured to the underside of the vibrating platform 13 and which is actuated by a rotary cam 14*a* cooperating with the free push rod end. Before the start of each shaking operation, the rotary cam is first shifted upwardly into the operational position by a distance y and upon completion of the shaking cycle, it is again lowered by the distance y. It is further noted that the distance y is so selected that even in the lowest vibrating position a clearance z between the member 12 and the lower edge of the collar 3*a* is ensured for preventing the collar edge from contacting the member 12 during the shaking operation.

The embodiment illustrated in FIG. 6 shows that the upper surface of the vibrating platform contacts only the end face 1*b* of the inner bag. In case the surfaces 13*b* and 13*c* are arranged in a common horizontal plane, the flanges 3*b* of the collar 3 are also resting on the vibrating platform 13. The end face 1*b* of the inner bag 1 and the flanges 3*b* together constitute the recessed side 16 of the package. Thus, a deformation or other damaging of the collar 3 is securely prevented.

It is to be understood that the above description of the present invention is susceptible to various modifications, changes and adaptations, and the same are intended to be comprehended within the meaning and range of equivalents of the appended claims.

What is claimed is:

1. In a device for shaking packages each positioned with a downwardly oriented, recessed end face on an intermittently advanced conveyor having carrier elements for engaging and advancing the packages; the improvement comprising at least one vertically displaceable platform situated underneath said conveyor and having a discrete outline dimensioned for engaging the recessed end face of the individual package; means for shifting said platform into a raised state for lifting the package off the respective carrier element by the recessed end face; and means for vertically reciprocating said platform in the raised state for shaking the package as it rests on said platform by said recessed end face; the distance by which said platform is lifted into said raised state is of sufficient magnitude for maintaining the package spaced from the respective carrier element during the shaking of the package by said platform.

2. A device as defined in claim 1, wherein there are provided a plurality of the platforms along the length of said conveyor.

3. A device as defined in claim 1, wherein each carrier element has two vertical opposite side walls and a third vertical side wall interconnecting the opposite side walls and angled carriers attached to said opposite side walls at median portions thereof for engaging the lowermost portions of the package only along a central portion thereof.

4. A device as defined in claim 1, wherein said platform has an upper central zone which is elevated with respect to upper marginal zones of said platform.

* * * * *